United States Patent [19]

Schaefer et al.

[11] Patent Number: 4,735,656

[45] Date of Patent: Apr. 5, 1988

[54] ABRASIVE MATERIAL, ESPECIALLY FOR TURBINE BLADE TIPS

[75] Inventors: Robert P. Schaefer, East Hartford; David A. Rutz, Glastonbury; Edward Lee, Higganum; Edward J. Johnson, Middletown, all of Conn.

[73] Assignee: United Technologies Corporation, Hartford, Conn.

[21] Appl. No.: 947,067

[22] Filed: Dec. 29, 1986

[51] Int. Cl.[4] ..... C22C 29/04

[52] U.S. Cl. ..... 75/238; 75/230; 75/236; 75/244; 419/13; 419/17; 419/23; 419/47

[58] Field of Search ..... 419/13, 17, 23, 47; 75/236, 244, 230, 238

[56] References Cited

U.S. PATENT DOCUMENTS 4,063,939 12/1977 Weaver et al. ..... 419/5
4,148,494 4/1979 Zelahy ..... 277/53
4,277,703 10/1980 Stalker et al. ..... 277/53
4,627,896 12/1986 Natmy et al. ..... 419/17

*Primary Examiner*—Stephen J. Lechert, Jr.
*Attorney, Agent, or Firm*—C. G. Nessler

[57] ABSTRACT

An abrasive material comprised of a metal matrix and evenly distributed ceramic particulates, is made by mixing powder metal with the ceramic powder and heating to a temperature sufficient to melt most, but not all of the powder. In this way the ceramic does not float to the top of the material, yet a dense material is obtained. A nickel superalloy matrix will have at least some remnants of the original powder metal structure, typically some equiaxed grains, along with a fine dendritic structure, thereby imparting desirable high temperature strength when the abrasive material is applied to the tips of blades of gas turbine engines. Preferred matrices have a relatively wide liquidus-solidus temperature range, contain a melting point depressant, and a reactive metal to promote adhesion to the ceramic.

23 Claims, 4 Drawing Sheets

ABRASIVE MATERIAL, ESPECIALLY FOR TURBINE BLADE TIPS

TECHNICAL FIELD

The present invention relates to the composition and manufacture of ceramic-metal abrasive materials, especially to those suitable for adhesion to the tips of turbine blades used in gas turbine engines.

BACKGROUND

Very close tolerances are sought between the spinning blades of the turbine section of a gas turbine engine and the circumscribing structure of the engine case. To achieve this, a portion of the engine case structure is surfaced with an abradable material. Such material generally remains intact, but is easily disintegratable when contacted by the spinning blade.

The abradable material is usually applied to small segments of metal, and in early engines, the abradable surfaces of the segments were made of relatively delicate metal, such as honeycomb or fiber metal. When the superalloy of turbine blades was insufficient in wear resistance, various hardfacing metals were applied.

But more recently, the demand for higher temperatures has led to the use of ceramic abradable surfaces on the static seals. Unfortunately, such materials are not so abradable as the metals they replace. And with the higher temperatures associated with ceramic seal use, the properties of the older metal turbine blade tips diminish. Not only do the high temperatures at turbine blade tips present wear problems, but the centripetal force associated with the high speed of blade spinning produces strains which can cause failure. Further, the cyclic temperature nature of the use can cause strains and failures associated with differential thermal expansions. Thus, resort was had to the use of composite metal-ceramic materials, such as the silicon carbide-nickel superalloy combination described in commonly owned U.S. Pat. No. 4,249,913 to Johnson et al.

As described in the Johnson patent, abrasive tips for turbine blades have been fabricated by pressing and solid state sintering of a mixture of metal and ceramic powders. Once made, the inserts are attached to the blade tip by brazing type processes. But both the manufacture of the abrasive tip material and adhering it to the tip have been difficult and costly.

The Johnson et al. type tips have performed well, and this is attributable to the uniform dispersion of ceramic in the metal matrix, a dispersion which is attainable by solid state processes.

But lower cost and higher performance alternatives have been sought, and these include plasma spraying and brazing type processes. Of course, conventional plasma spraying of a mixture of ceramic and metal has long been known, but such simple processes do not produce the requisite wear resistance and high temperature strength. Specialized plasma spray techniques have been developed, such as one in which a superalloy matrix is sprayed over previously deposited grits, followed by hot isostatic pressing. However, the technique is best used where only a single layer of particulate is sufficient.

And in both the Johnson et al. and the plasma spray processes, the grain size of the matrix is fine, a reflection of the fine grain powders. Fine grain size tends to limit creep strength at high temperature.

Fusion welding of ceramic and metal composites is not feasible with superalloy turbine blades since the substrate metal has a specialized metallurgical structure which is disturbed by the high temperature of fusion. A uniform deposit of metal and ceramic powders can be placed on a substrate through plasma spraying, or other powder metal techniques, such as are used to place brazing powders, and the deposit can then be heated to its temperature of fusion to consolidate such into a cast mass. However, it is found that doing such does not result in a uniform dispersion of ceramic in the matrix; the ceramic tends to go to the surface of the fused material due to buoyancy. In the critical applications like turbine blades, there must be achieved uniformity, to optimize the properties of the abrasive material, and minimize the weight which the turbine blade must carry.

DISCLOSURE OF THE INVENTION

An object of the invention is to provide a ceramic particulate containing superalloy material which has a sound metal matrix with evenly distributed particulates. A further object is to provide a metallurgical structure in the matrix material that has better high temperature properties than solid state powder metal abrasives.

According to the invention a ceramic particulate containing abrasive material is formed by mixing a metal powder with the ceramic particulate and then heating the mixture to a temperature which is sufficient to melt a substantial portion, but not all of the metal, to cause fusion and densification of the mixture. Upon cooling, the fused mixture will have the ceramic substantially evenly distributed throughout and the metallurgical structure will be in part reflective of the original structure of the metal powder.

In a preferred use of the invention, silicon carbide or silicon nitride type ceramic is uniformly mixed with a nickel base superalloy powder and thermoplastics to form a tape like material. The tape is cut to shape and adhered to the tip of a gas turbine engine blade made of a nickel superalloy. The assembly is heated in vacuum to drive off the thermoplastic, and then to temperature of about 2340 F which results in about 80% of the metal being liquified. After about 0.3 hr the part is cooled and micro-examination shows that the particulates quite evenly distributed in the metal which is substantially free of porosity. This compares with lesser heating which produces porosity in the metal and greater heating which causes the ceramic to float and become unevenly distributed. The metallurgical structure of the better matrix made by the invention process has within it some equiaxed grains and some fine dendritic structure. Such structure has good high temperature properties, contrasted with the aforementioned porous structure and the coarser fully dendritic structure associated with heating to a higher temperature.

The preferred metal matrices of the invention have a significant temperature difference between liquidus and solidus, they are composed of nickel, cobalt, iron and mixtures thereof, and they contain a reactive metal element, such as yttrium, hafnium, molybdenum, titanium, and manganese, which promotes adhesion of the metal matrix to the ceramic.

The invention is capable of economically producing abrasively tipped gas turbine blades, and the resultant blades have good performance.

The foregoing and other objects, features and advantages of the present invention will become more apparent from the following description of preferred embodiments and accompanying drawings.

BEST MODE FOR CARRYING OUT THE INVENTION

Figure 1:
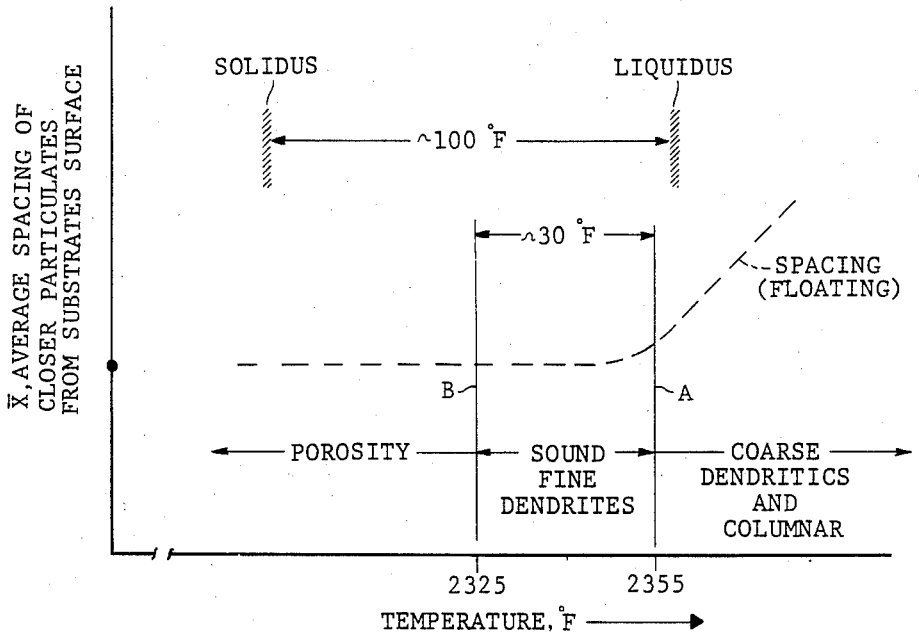
FIG. 1 is a graph showing how sintering temperature affects the floating of particulates and the metallurgical structure of the metal.

The invention is described in terms of making a high temperature abrasive material comprised of silicon carbide particulate contained within a superalloy matrix, where such material is formed on a substrate, such as the tip of a turbine blade, as is described in more detail in the related copending application Ser. No. 353,764, filed 3/1/82, now U.S. Pat. No. 4,439,241, issued 3/27/84. But in special circumstances, abrasive materials can be formed and used without the presence of a substrate. In this best mode description, the substrate is a single crystal nickel superalloy, such as the nominal alloy known as PWA 1480, generally described in U.S. Pat. No. 4,209,348 to Duhl et al.

Preferably, the material of the invention is formed by mixing metal and ceramic particulate with a polymer binder and forming the mixture into a flat strip of material. The substance can then be cut into convenient pieces adapted to the substrate on which a hardfacing is desired, and adhered to it. Upon heating, the polymer is caused to volatilize or decompose, leaving the desired metal and ceramic constituents. Such technology is old and is described in U.S. Pat. No. 4,596,746 to Morishita et al. and U.S. Pat. No. 4,563,329 also to Morishita et al., the disclosures of which are hereby incorporated by reference.

Alumina coated silicon carbide ceramic particulate, like that described in U.S. Pat. No. 4,249,913 to Johnson et al., is used. The disclosure of the patent is hereby incorporated by reference. The alumina coating is intended to prevent interaction between the ceramic and metal matrix during fabrication and use. The ceramic particle size is −35+45 mesh (420–500 micrometer); there is 15–25, more preferably 25, volume percent ceramic particulate in combination with the metal. The size and content of ceramic is selected for good performance in the end use application in turbine blade tips.

The powder metal, hereinafter referred to as Tipaloy 105, has the composition by weight percent 24–26 Cr, 7.5–8.5 W, 3.5–4.5 Ta, 5.5–6.5 Al, 0.5–1.5 Hf, 0.05–0.15 Y, 1.1–1.3 Si, balance essentially Ni. There is no more than 0.1 P, S, and N, no more than 0.06 O, 0.005 H, and 0.5 other elements. Nominally, the composition is Ni, 25 Cr, 8 W, 4 Ta, 6 Al, 1.2 Si 1 Hf, 0.1 Y. The metal particle size is −80 mesh US Sieve Size (nominally, minus 177 micrometer dimension); the size of the metal powders is not particularly critical in carrying out this preferred aspect of the invention, and the distribution is typical of atomized powder metals with a significant fraction below 325 mesh (44 micrometer).

The metal and ceramic ingredients are blended together with polymer materials to form a tape, generally in accord with the patents referenced above. As an example, the commercial polymer Methocel (Dow Chemical Co., Midland, Mich., U.S.A.) is mixed with a wetting agent and a plasticizer such as tri-ethylene glycol, a defoaming agent, and water. The material is molded into sheet or tape of nominally 0.060 inch thick using a screed board technique. The tape is then cut to the desired shape, to fit the substrate or to be slightly larger. The tape piece is bonded to the substrate using a commercial adhesive such as Nicrobraz 300 cement (Wall Colmonoy Corp., Detroit, Mich., U.S.A.). The tape piece may be segmented to limit the gross physical movement of the tape as it shrinks during the initial heating. Commercial ceramic stop off material, such as used in brazing, is applied to the adjacent substrate regions to prevent unwanted liquid metal flow during the subsequent sintering/fusing step.

The assembly is heated in a vacuum furnace, first to volatilize or decompose the polymeric binders, and then to a temperature of about 2340° F. for about 0.3 hour to cause melting and fusion of the metal to itself and to the ceramic particulate. This step may alternatively be called liquid phase sintering or fusing. Herein, the term sintering is used herein to describe such. The heating may be combined with the solutioning or other metallurgical processing of the substrate when such is convenient. After heating for a sufficient time to achieve the objects of the invention, the assembly is cooled to solidify the abrasive material matrix. Typically, the resultant abrasive material will be about 0.035 inch thick prior to finish machining. There will be nominally 2-3 layers of ceramic particulates through its thickness. The superficial appearance of the abrasive material will be that of a substrate that has melted and solidified. At its free surfaces, the substance will tend to have curved edges, characteristic of surface tension effects in molten metals.

The temperature of heating is quite critical to the invention. If the metal is heated too little, then there is insufficient densification of the powder metal and porosity is found. This results in low strength in the abrasive material being formed. In turbine blade applications strength is very important. If the metal is heated too much, then the ceramic particulate will float to the top of the liquid mass, giving an uneven distribution of particulate. A substantially even distribution in the matrix metal is necessary for uniform wear and properties of the material.

Figure 2:
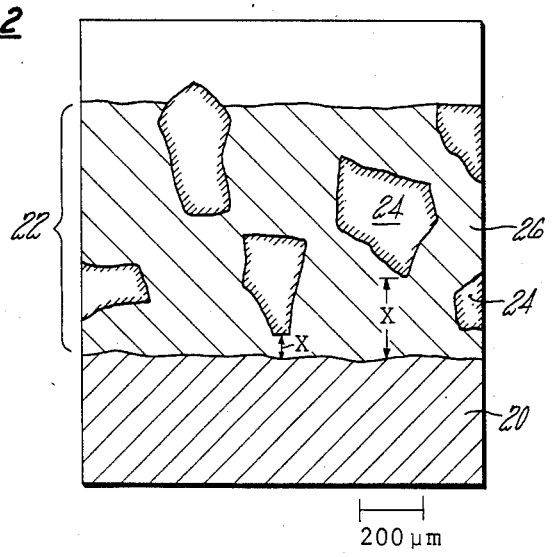
FIG. 2 is a schematic photomicrograph showing how alumina coated silicon carbide particulates are evenly contained in the fused metal matrix when sintering is done according to the invention.

The Figures illustrate the foregoing effects for the materials combination described above. FIG. 1 shows the effect of sintering temperature on ceramic flotation and on metallurgical structure. The degree of ceramic particulate floating is measured according to the average spacing of the lowermost particulates from the substrate, as measured on a metallurgical mount, schematically shown in FIG. 2. FIG. 2 shows abrasive material 22 fused to a substrate 20. The material 22 has a matrix 26 containing evenly distributed ceramic particulates 24. Each lowermost particulate has a spacing x, the average being $\bar{x}$. The average $\bar{x}$ is used as a measure of the degree of flotation. Because the particulate is randomly distributed, $\bar{x}$ cannot be zero. Typically, the best abrasive materials made as described just above, with substantially evenly distributed particulates as shown in FIG. 2, will have $\bar{x}$ values of 0.005 inch.

Figure 3:
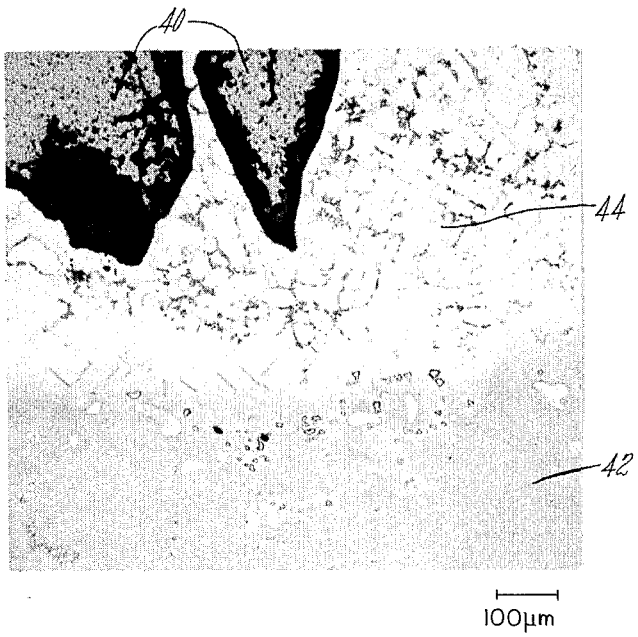
FIGS. 3–5 are photomicrographs, showing the desirable metallurgical structure associated with the invention.
Figure 4:
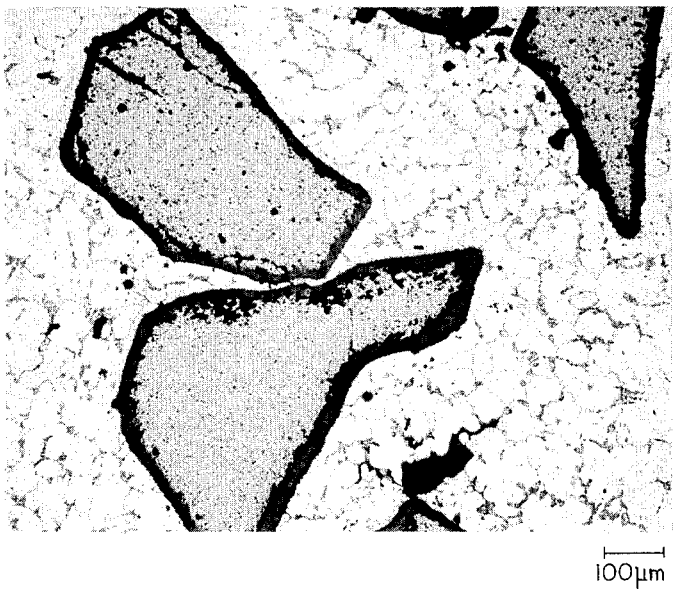
Figure 5:
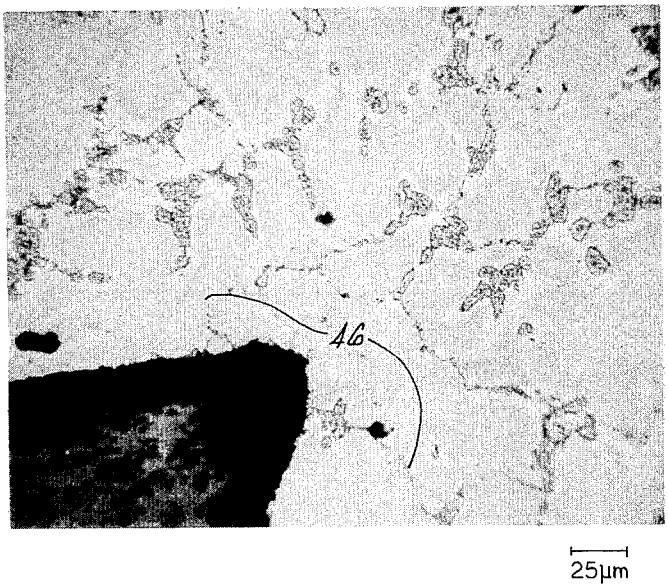
Figure 6:
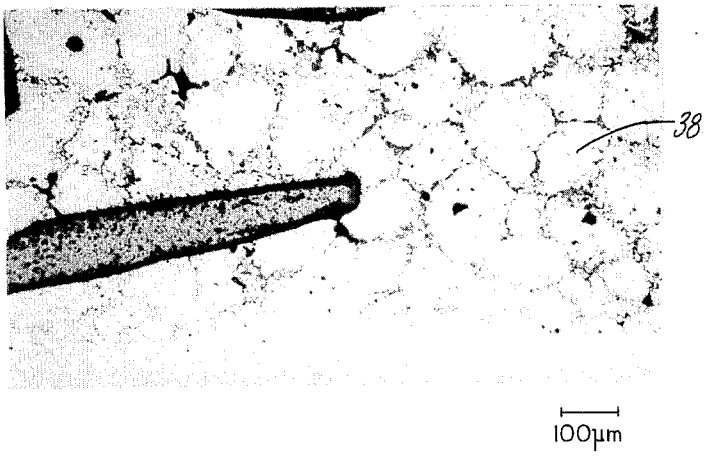
FIG. 6 is a photomicrograph showing the structure of a material sintered at the lower end of the useful range where there is a substantial equiaxed grain structure reflective of the original powder.
Figure 7:
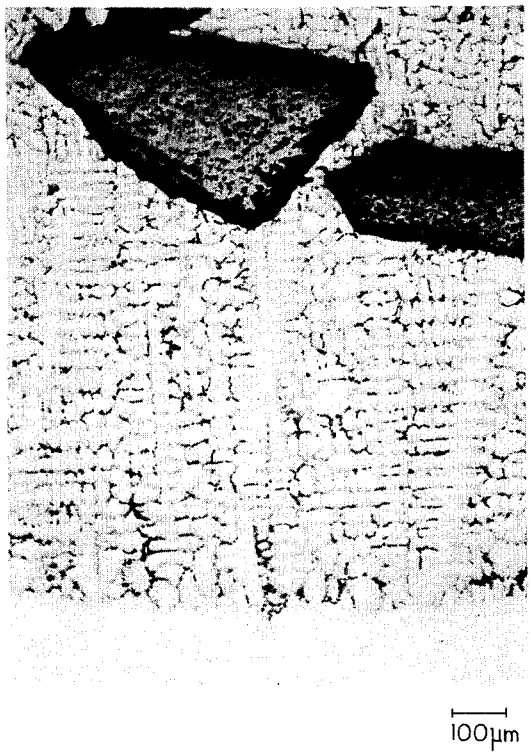
FIG. 7 is a photomicrograph showing an undesired metallurgical coarse dendritic structure and grit floating which results when temperatures are higher than those used in the invention.

FIG. 2 illustrates the substantially even ceramic spacing obtained when flotation is limited. In contrast FIG. 7 shows how the grits move away from the substrate when floating occurs. FIG. 3–5 show the microstructure of a typical material etched using 69 lactic acid, 29 nitric acid, 2 hydrofluoric acid. The structure is associated with sintering at temperatures to the left of the line A in FIG. 1, within the liquidus-solidus range. Line A nominally corresponds with but is slightly below the liquidus temperature. However, merely exceeding the solidus is not sufficient. As FIG. 1 shows, at temperatures below that of line B, even though there is substantial melting due to being about 70° F. over the solidus temperature, the resultant structure is porous due to insufficient melting. Exactly how much into the liquid-solid range the temperature must be raised to avoid porosity will depend on the particular alloy system. With the Tipalloy 105 described here, the nominal temperature of 2340° F. is about 85% into the range. FIG. 6 shows the microstructure of a material which has been heated just sufficiently to cause fusion of the powder particles and produce predominantly equiaxed grain 38. It is notable that there is minor porosity shown in FIG. 6 as well as in the other Figures, but such minor porosity is characteristic of a material that is considered in an engineering sense to be fully dense, or free of porosity.

FIG. 3 shows silicon carbide grits 40 floating just above a PWA 1480 alloy substrate 42. The fine dendritic structure 44 is evident in the matrix. FIG. 4 is a view at another location in the abrasive, further away from the matrix, again showing the fine structure. FIG. 5 is a higher magnification view of the structure shown in FIG. 4 and some of the grain boundaries become barely discernible.

The metallurgical structure is important to the high temperature strength of the superalloy matrix and the invention is intended to obtain such. A good metallurgical structure produced in the invention is one obtained by sintering at a temperature equal or less than line A in FIG. 1. It is one characterized by at least some remnant, such as equiaxed grain, of the original powder structure, with a relatively fine dendritic structure, such as shown in FIG. 3–5. By fine dendritic structure is meant that which has spacing and size which is small compared to that which characterizes dendrites in matrix which has been raised significantly above the liquidus temperature. Compare FIG. 4 with FIG. 7. The structure which is a remnant of the original powder metal is very apparent when temperatures are near the B line in FIG. 1, as evidenced by FIG. 6. There it is clearly seen that there are some of the powder particles which have undergone partial melting and there has been subsequent epitaxial solidification which has resulted in a coarser structure. Typically, the origial powder particles will have a very fine dendritic structure characteristic of the rapid cooling which occurs during atomization. Depending on the degree and time of heating such structure becomes homogenized and less resolvable, and this tends to be the case in here. But it is fairly clear that there is a substantial difference in the structure when the powder is completely melted, as evidenced by FIG. 7. As in Fig. 7, sintering above line A will first produce relatively coarse and fully dendritic structure. An even more undesired columnar grain structure will result if the temperature is significantly in excess of line A. Both excess-temperature structures have comparatively poorer higher temperature properties.

Obtaining the structure which has the desired morphology and is substantially free of porosity is achieved by heating very near to but less than the liquidus. The most desired obvious equiaxed structure is obtained but not entirely melting at least some of the powder metal. Ideally, heating at near line B will result in an almost entirely equiaxed structure as the liquid material appears to resolidify epitaxially from the unmelted material. More usually, there is 10–70 volume percent equiaxed structure. Except when there is entirely equiaxed grain, there will be also present the fine dendritic structure. Because of the aforementioned epitaxy and the effects of elevated temperature, the grain size of the abrasive materials are substantially larger than the grain size in the original powder metal particles. The structures of the invention have associated with them substantially improved high temperature creep strength, compared to unfused powder metal materials.

The Tipaloy 105 material and other alloys having properties useful in the applications of the invention will be desired according to the greatness of temperature range between lines A and B. The 30° F. range for Tipaloy 105 is considered to be good in that it is practical for production applications with superalloy substrates.

The Tipaloy 105 material just described is a typical matrix material. It is a beta phase superalloy with good high temperature strength and oxidation resistance. By superalloy is meant a material which has useful strength and oxidation resistance above 1400° F., and it characteristically will be an alloy of nickel, cobalt, iron and mixtures thereof. The superalloys most useful for making ceramic particulate abrasives will have within them elements which aid in the adhesion of the ceramic to the matrix, such as the elements Hf, Y, Mo, Ti, and Mn; such are believed to aid wetting of the ceramic. In order to obtain a melting point of the matrix which is compatible with the substrate, as in Tipaloy 105, silicon may be used as a melting point depressant. As illustrated by the following examples, other melting point depressant elements may be used separately or in combination. These include B, P, and C. Thus, in the preferred practice there will be least one element selected from the group B, Si, P, C and mixtures thereof. Typically, the weight percentages of such elements will range between 0–4 Si, 0–4 B, 0–1 C and 0–4 P, with the combining and total amounts being limited to avoid brittleness in the end product matrix.

Various ceramics may be used, so long as good metal-ceramic adhesion is achieved. For the abrasive materials which are the prime object of the present invention, it is necessary that the ceramic not interact with the metal matrix because this degrades the wear resistance of the ceramic and thus the entirety of the material. Ceramics which are not inherently chemically resistant must be coated as is the silicon carbide. Other essential materials which may or may not be coated with another ceramic and which are within contemplation for high temperature applications include silicon nitrides and the various alloys of such, particularly silicon-aluminum oxynitride, often referred to as SiAlON. Boron nitride is a material that some have favored. Of course, it is feasible to mix such materials. At lower temperature virtually any ceramic may be used, depending on the intended use of the ceramic-metal composite.

For different applications, other metal alloy systems than those mentioned may be used while employing the principles of the invention. For instance, nickel-copper may be used. Generally, the metal alloy must have a significant liquidus-solidus temperature range, compared to the capability of heating the materials being processed, and the heat conductance of the mixture.

While the preferred method is to make the tape mentioned above, the principles of the invention can be carried out without the use of any polymer material. For instance, the metal and ceramic particulates can be mixed and placed in a cavity in the substrate where they will be contained during the heating step. As noted, at elevated temperatures, when there is no polymer present irrespective of its initial use, the phenomena are such that the abrasive material tends to remain in place on a flat surface without containment (other than ceramic stop-off materials).

While the prevalent use of the material of the invention will be to form and use it on a substrate needing protection, the abrasive material may be removed from the metal or ceramic substrate on which it is formed and used as a free standing body.

In the following examples the best mode practices just described are generally followed except where deviations are mentioned.

EXAMPLE I

A mixture of two powder metals is used. The first powder metal has the composition by weight percent 24–26 Cr, 7.5–8.5 W, 3.5–4.5 Ta, 5.5–6.5 Al, 0.5–1.5 Hf, 0.05–0.15 Y, 0.20–0.25 C, balance essentially Ni. There should be no more than 0.1 P, S, and N, no more than 0.06 C, 0.005 H, and 0.5 other elements. Preferably the composition is Ni, 25 Cr, 8 W, 4 Ta, 6 Al, 1 Hf, 0.1 Y. The alloy is called Tipaloy I. The second powder metal has the composition by weight percent Ni, 15 Cr, 3.5 B. It has a significantly lower melting point than the Tipaloy I and is sold by the tradename Nicrobraze 150 powder (Wall Colmonoy Corp., Detroit, Mich., U.S.A.). The metal particulate comprises by weight percent Tipaloy 60–90, more preferably 70; and Nicrobraze 150, 10–40, more preferably 30.

In this practice of the invention the powder size is important. It has been found that −325 mesh is less preferred because there is a pronounced greater tendency for the ceramic to float, compared to −80 mesh powder sintered at the same temperature.

EXAMPLE II

Tipaloy I powder is used with 5 weight percent powder having the composition of specification AMS 4782 (Aerospace Material Specification, U.S. Society of Automotive Engineers). This material is by weight percent Ni-19Cr-10Si and it provides 0.5–0.75 percent silicon in the alloy resulting from the combination of the two metal powders. The material is sintered at 2360° F. for 0.3 hr.

EXAMPLE III

Tipaloy I is the only metal present and the assembly is heated to 2365° F. for 0.2 to 2 hr.

EXAMPLE IV

The substrate is a lower melting point alloy, MARM 200+Hf. Three powder metal constituents are used: By weight 50 percent Tipaloy I, 5 percent Nicrobraze 150, 45 percent AMS 4783 (Co-19-Cr-17Ni-4W-0.8B). Heating is at 2250° F.

In Examples I, II and IV it is observed that the lower melting point constituents will tend to melt first, but they will also alloy with and cause melting of the predominant metals present during the course of obtaining sufficient melting to produce the requisite density.

Although this invention has been shown and described with respect to a preferred embodiment, it will be understood by those skilled in the art that various changes in form and detail thereof may be made without departing from the spirit and scope of the claimed invention.

We claim:

1. The method of making an abrasive material comprised of evenly dispersed ceramic particulates surrounded by a fused matrix of metal having a density greater than the density of the ceramic material, characterized by mixing metal particulate with ceramic particulate, heating the mixture to a temperature sufficient to cause partial melting of the metal so that it fuses into a dense matrix when cooled, but insufficient to cause the ceramic particulate to substantially float in the metal matrix.

2. The method of claim 1 characterized by producing a metallurgical structure which is a combination of equiaxed grains and fine dendrites.

3. The method of claim 1 characterized by the metal being a superalloy based on nickel, cobalt, iron or mixtures thereof.

4. The method of claim 1 characterized by a superalloy matrix based on nickel, cobalt, iron or mixtures thereof, the superalloy containing at least one element selected from the group consisting of essentially Y, Hf, Mo, Ti, and Mn, and at least one element selected from the group consisting of essentially B, Si, P and C.

5. The method of claim 1 characterized by producing in the cooled metal a metallurgical structure which has at least some equiaxed grains which are derived from unmelted parts of the powder metal.

6. The method of claim 3 characterized by the metal having a liquidus-solidus temperature difference of at least 100° F., wherein the temperature of heating produces more than 85 volume percent liquid.

7. The method of claim 1 characterized by using two different compositions of metal particulate, a first composition having a melting point lower than the second composition.

8. The method of claim 1 characterized by mixing 15–25 volume percent ceramic particulate with 75–85 volume percent metal particulate.

9. The method of claim 3 characterized by using a ceramic particulate which is selected from the group consisting of essentially silicon carbide, silicon nitride, silicon-aluminum-oxynitride and mixtures thereof.

10. The method of claim 3 characterized by the metal particulate containing a reactive metal selected from the group consisting of Y, Hf, Mo, Ti, Mn and mixtures thereof.

11. The method of claim 3 characterized by a metal particulate consisting essentially by weight percent of 24–26 Cr, 7.5–8.5 W, 3.5–4.5 Ta, 5.5–6.5 Al, 0.5–1.5 Hf, 0.05–0.15 Y, balance Ni, and additions of at least one element selected from the group consisting of essentially P, B, C and Si.

12. An abrasive material comprised of ceramic material particulate within a matrix of metal having a density greater than the density of the ceramic material, characterized by the ceramic particulate being evenly distributed in a dense fused matrix having at least some equiaxed grains in its metallurgical structure.

13. The material of claim 12 having a metallurgical structure characterized by a combination of equiaxed grain and fine dendritic structure.

14. The material of claim 12 wherein the metal is a superalloy based on nickel, cobalt, iron or mixtures thereof.

15. The material of claim 14 wherein the superalloy contains at least one element selected from the group consisting of Y, Hf, Mo, Ti, and Mn.

16. The material of claim 14 wherein the superalloy contains at least one element selected from the group consisting of B, Si, P and C.

17. The material of claim 16 wherein the group consists by weight percent of 0.4 Si, 0.2 B, 0.4 C and 0.4 P.

18. The material of claim 12 characterized by the ceramic particulate being selected from the group consisting of essentially silicon carbide, silicon nitride, silicon-aluminum-oxy-nitride and mixtures thereof.

19. The material of claim 18 characterized by 15–25 volume percent ceramic particulate.

20. An abrasive material comprised of evenly dispersed ceramic material particulate surrounded by a fused matrix of metal having a density greater than the density of the ceramic material, characterized by being made by heating a mixture of metal particulate and ceramic particulate to a temperature sufficient to only partially melt the metal particulate, but insufficient to cause floating of the ceramic particulate within the metal matrix.

21. The material of claim 20 characterized by a ceramic particulate having a US Sieve Size of 35–45 mesh (nominally 420–500 micrometer).

22. The material of claim 20 wherein the metal powder is comprised of at least two constituent powders, the firsrt being a superalloy material and the second being a material containing a substantial amount of melting point depressant selected from the group consisting of B, Si, P, C and mixtures thereof.

23. The material of claim 20 charcterized by the metal powder having a particle size which is substantially −80 mesh US Sieve Size (−177 micrometer).

* * * * *